United States Patent [19]

Tsuchiyama

[11] 4,366,699

[45] Jan. 4, 1983

[54] HYDRAULIC PRESSES

[75] Inventor: Yuji Tsuchiyama, Hatano, Japan

[73] Assignee: Amada Company, Limited, Kanagawa, Japan

[21] Appl. No.: 266,320

[22] Filed: May 22, 1981

[30] Foreign Application Priority Data

May 26, 1980 [JP] Japan ..... 55-069041
May 26, 1980 [JP] Japan ..... 55-069042

[51] Int. Cl.[3] ..... B21D 7/06; B21J 7/46

[52] U.S. Cl. ..... 72/389; 72/241; 72/453.14; 100/258 A

[58] Field of Search ..... 72/389, 386, 380, 441, 72/453.14; 100/258 A, 258 R, 46

[56] References Cited

U.S. PATENT DOCUMENTS 1,900,050 3/1933 Ernst ..... 100/258 A
3,007,508 11/1961 Giordano ..... 72/386
4,282,738 8/1981 Kojima ..... 72/389

FOREIGN PATENT DOCUMENTS 749720 5/1943 Fed. Rep. of Germany ..... 72/389
1126249 12/1960 Fed. Rep. of Germany ... 100/258 R
2115851 7/1972 France .

*Primary Examiner*—Gene Crosby
*Attorney, Agent, or Firm*—Wigman & Cohen

[57] ABSTRACT

A hydraulic press such as a press brake is disclosed having a pair of long movable and fixed tools which are always kept in parallel with each other by detecting the obliquities of the movable and fixed tools and controlling the fluid delivery to hydraulic motors which drive the movable tool. Each hydraulic motor is controlled by a valve which is actuated by a rocking cam arrangement. The limit of movement of the movable tool toward the fixed tool also can be easily adjusted by adjusting the rocking cam arrangement.

2 Claims, 4 Drawing Figures

HYDRAULIC PRESSES

BACKGROUND OF THE INVENTION

1. Field of the Invention

The present invention relates generally to hydraulic presses, such as press brakes for working or processing sheet-like workpieces, such as sheet metals, and pertains more particularly to hydraulic presses which are equipped with a pair of long upper and lower tools either of which is hydraulically operated to work or process sheet-like workpieces in cooperation with each other.

2. Description of the Prior Art

Some hydraulic presses, such as those which are referred to as hydraulic press brakes, are equipped with a pair of long upper and lower tools to work or process sheet-like workpieces, such as sheet metals, mainly to bend them into shapes, such as channels and angles. In such hydraulic presses, either of the long upper and lower tools is horizontally fixed to a beam member and the other of them is horizontally mounted on a beam-like ram member which has a horizontally long holding portion and is hydraulically operated. In order to drive the movable tool which is long in shape, the beam-like ram member is so arranged as to be driven vertically at its ends by a pair of hydraulic motors of cylinder types into and out of which hydraulic motors of cylinder types into and out of which hydraulic fluid is delivered and exhausted. In this arrangement, the beam-like ram member is vertically driven to drive the movable tool vertically toward and away from the fixed tool to work or process a sheet-like workpiece placed between the movable and fixed tools when the hydraulic motors are supplied with the hydraulic fluid. Also, the hydraulic motors are controlled to enable the ram member to stop the movable tool at a distance from the fixed tool according to the thickness, width and tensile strength of the workpiece to be worked and the shape or angle into which the workpiece is to be worked or bent.

In the conventional hydraulic presses of the kind described above, the beam-like ram member will often fail to move equally both ends of the long movable tool in such a manner as to keep the ends always at a level with each other. In other words, the beam-like ram member will often fail to evenly move in equilibrium in order to evenly drive the movable tool with the ends thereof kept always at a level with each other. Therefore, the movable tool will become oblique or offset relative to the fixed tool. The beam-like ram member will almost inevitably fail to evenly move in equilibrium from various causes, such as a difference between frictions or sliding resistances of guide means at the ends of the ram member and a difference between fluid resistances in the hydraulic motors and their hydraulic circuits. Furthermore, even if the beam-like ram member can evenly move in equilibrium, the movable and fixed tools will become oblique to each other, since the beam-like ram member and the beam member holding the movable and fixed tools, respectively, will deflect from each other from various causes. For instance, the beam-like ram member and the beam member will deflect from each other when a narrow workpiece is being worked or bent at other than central portions of the movable and fixed tools and when the workpiece is uneven in tensile strength or in thickness, even if worked or bent at the central portions of the movable and fixed tools. As a matter of course, the workpiece cannot be accurately worked or processed if either of the movable and fixed tools becomes oblique to the other, much less if both of them become oblique to each other. For instance, if either of the movable and fixed tools is oblique to the other, the sheet-like workpiece cannot be equally bent as a whole and will be bent into different angles at portions and especially at the opposite ends.

Another disadvantage with the conventional hydraulic presses has been that it is very difficult and time-consuming to accurately adjust the moving limit of the movable tool to the fixed tool, i.e. the shortest distance between the movable and fixed tools according to the thickness, width and tensile strength of workpieces to be processed. Of course, the movable and fixed tools cannot work accurately and will often break or prematurely wear unless the moving limit of the movable tool to the fixed tool is accurately adjusted.

SUMMARY OF THE INVENTION

It is an object of the present invention to provide a hydraulic press having a pair of long movable and fixed tools in which the movable and fixed tools are kept always in parallel with each other when working or processing a workpiece, even if the ram member holding the movable tool fails to evenly move in equilibrium, or even if either of the ram member and the beam member holding the upper and lower tools, respectively, is deflected away from the other, or both of them are deflected away from each other.

It is therefore an object of the present invention to provide a hydraulic press in which the deflection of the frame occurring during an operation can be automatically compensated to enable the movable and fixed tools to accurately work or process the workpiece.

Basically, these objects of the present invention are accomplished by providing a means for detecting the obliquities of the movable and fixed tools and a means for controlling the hydraulic fluid delivered into hydraulic motors for driving the ram member.

It is another object of the present invention to provide a hydraulic press in which the moving limit of the movable tool to the fixed tool ca be accurately and easily adjusted according to the dimensions and the tensile strength of the workpiece to be processed.

This object of the present invention is accomplished by providing valve means for controlling the hydraulic motor which drives the ram member and a means for adjusting the control valve means.

Therefore, it is an ultimate object of the present invention to provide a hydraulic press which will accurately work and can be easily operated.

Other and further objects and advantages of the present invention will be apparent from the following description and accompanying drawings which, by way of illustration, show preferred embodiments of the present invention and the principle thereof.

DESCRIPTION OF THE PREFERRED EMBODIMENTS

Figure 1:
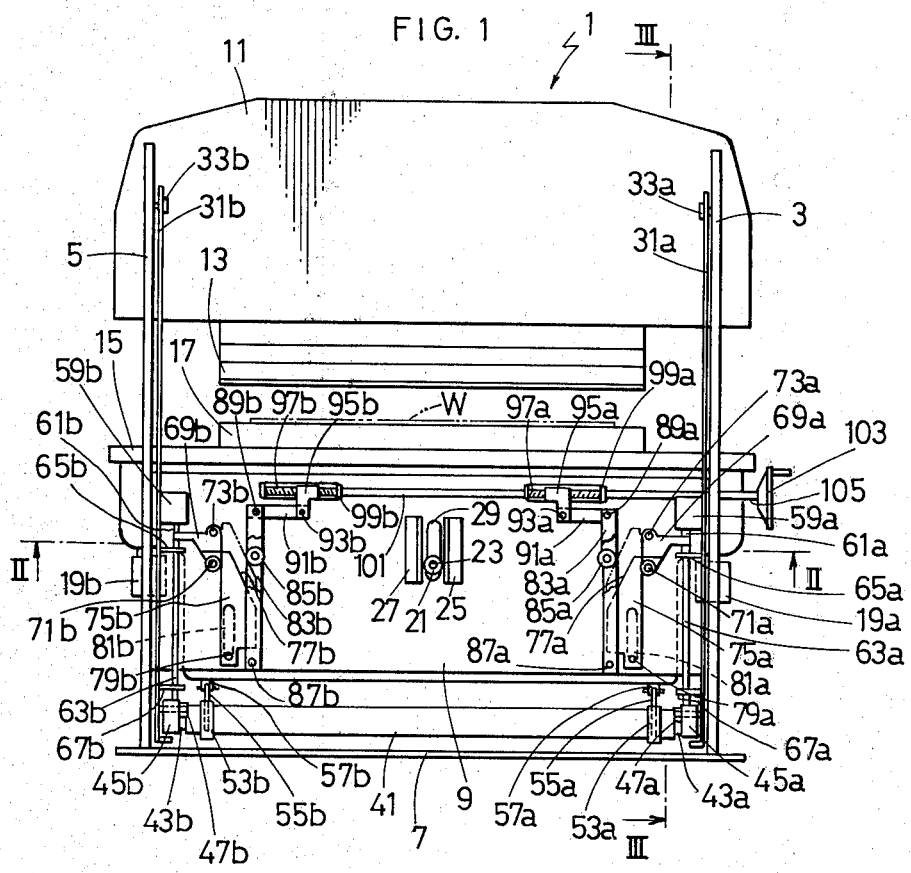
FIG. 1 is a rear elevational view of a hydraulic press embodying the principles of the present invention with portions shown in section.
Figure 2:
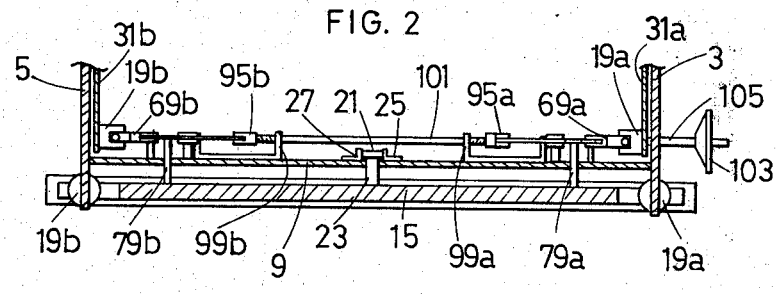
FIG. 2 is a sectional view of the hydraulic press shown in FIG. 1 taken along the line II—II of FIG. 1 and shown with portions omitted for clarity.
Figure 3:
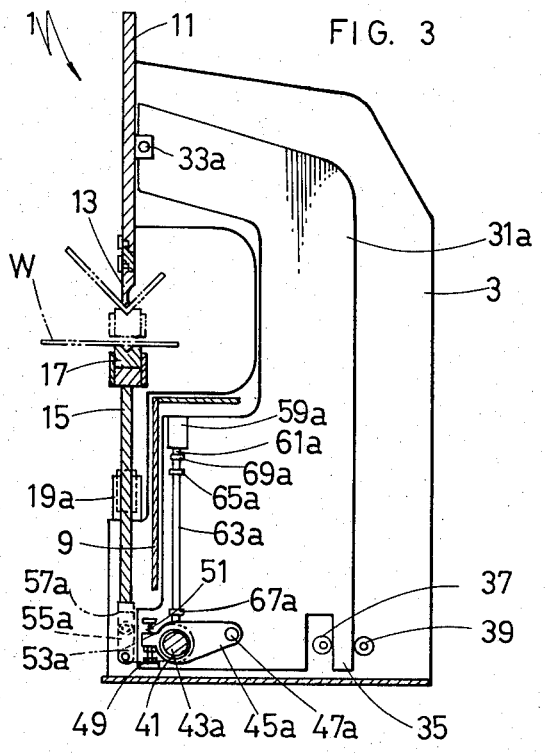
FIG. 3 is a side sectional view of the hydraulic press shown in FIG. 1 taken along the line III—III of FIG. 1.

Referring to FIGS. 1, 2 and 3, the present invention will be described with regard to a hydraulic press 1 which is often referred to as a hydraulic press brake and is used mainly to bend sheet-like materials, such as sheet metals, into shapes such as channels and angles. The hydraulic press 1 comprises a pair of C-shaped upright plates 3 and 5 which are vertically disposed in parallel with each other and are integrally connected with each other by a base plate 7 at their lower ends and also by a connecting plate 9 at their lower portions. Specifically, the connecting plate 9 is vertically disposed to connect the lower front portions of the upright plates 3 and 5 so that a space is provided behind the connecting plate 9 and between the lower portions of the upright plates 3 and 5. The hydraulic press 1 also comprises a horizontal overhead beam member 11 connecting the upper ends of the upright plates 3 and 5 and horizontally holding a detachable upper tool 13 at its lower end and further comprises a ram member 15 horizontally holding a detectable lower tool 17 at its top end.

As seen from FIGS. 2 and 3, the ram members 15 is vertically movably disposed in front of the connecting plate 9 in a manner such that the lower tool 17 is located just beneath the upper tool 13 held by the beam member 11. Also, the ram member 15 is so arranged as to be driven toward and away from the upper tool 13 by a pair of hydraulic motors 19*a* and 19*b* of cylinder types which are mounted on the upright plates 3 and 5, respectively. As shown in FIG. 1, the ram member 15 is guided by a guide roller 21 having a shaft 23 and a pair of guide rails 25 and 27 which are vertically fixed to the connecting plate 9 in parallel with each other, although of course there may be other guide means. More particularly, the guide rails 25 and 27 are fixed to the rear portion of the connecting plate 9, and the guide roller 21 is rotatably provided on the rear side of the ram member 15 in such a manner as to project out rearwardly between the guide rails 25 and 27 through an elongate hole 29 formed therebetween. Also, the sheet-like workpiece W to be worked or bent is placed on the lower tool 17 on the ram member 15 by use of a suitable positioning means which is usually provided behind the ram member 15 and between the upright plates 3 and 5.

In the above described arrangement, the ram member 15 is raised vertically by the hydraulic motors 19*a* and 19*b* to enable the upper and lower tools 13 and 15 to cooperate with each other to bend the workpiece W placed on the lower tool 15 as shown by the imaginary lines in FIG. 3 when the hydraulic motors 19*a* and 19*b* are supplied with the hydraulic fluid. Also, the ram member 15 can lower itself by its own gravity to its original position in order to bring down the lower tool 15 together with the workpiece W which has been bent, when the hydraulic fluid is exhausted from the hydraulic motors 19*a* and 19*b*.

In this connection, it is to be noted that the present invention is not limited in application to the hydraulic press 1 shown in the drawings in which the lower tool 17 is held and moved by the ram member 15 toward and away from the upper tool 13 which is fixed. Although the present invention has been described hereinbefore and will be described hereinafter with regard to the hydraulic press 1 shown in the drawings, it should be noted that the present invention is also applicable to a hydraulic press in which a lower tool is fixed and an upper tool is so arranged as to be moved by a ram member toward and away from the lower tool. Also, of course, the present invention is not limited in application to the hydraulic press 1 which is often referred to as a hydraulic press brake and is used mainly to bend the sheet-like workpieces. The invention is applicable to any suitable known type of hydraulic presses.

In the meantime, the hydraulic press 1 according to the present invention is provided with many pairs of members or elements which are symmetrical to each other and are disposed at opposite portions as seen from FIG. 1. For convenience sake, therefore, each pair of symmetrical elements will be described hereinafter with common numerals which are distinguished from each other by accompanying letters "a" and "b" as in the case of the hydraulic motors 19*a* amd 19*b* described above. Also only one of symmetrical elements will be described, as the case may be.

Referring again specifically to FIGS. 1, 2 and 3, a pair of C-shaped dependent plates 31*a* and 31*b* are connected to the insides of the upright plates 3 and 5, respectively, by pins 33*a* and 33*b*, respectively, in such a manner as to depend down to the lower ends of the upright plates 3 and 5 in contact therewith. Each of the dependent plates 31*a* and 31*b* is formed at its lower portion with a vertical projection 35 and is held stopped from swinging about the pins 33*a* and 33*b* by a pair of rollers 37 and 39 which are pivotally disposed to the upright plates 3 and 5 so as to hold the projection 35 on the opposite side thereof. Thus, when the upright plates 3 and 5 are deflected upward and restored downward, the dependent plates 31*a* and 31*b* will be raised and lowered by the guide of the rollers 37 and 39 by the upright plates 3 and 5 by means of the pins 33*a* and 33*b*, although they are held stopped by the rollers 37 and 39 from swinging about the pins 33*a* and 33*b*.

As shown in FIGS. 1 and 3, a torsion bar 41 is horizontally disposed in the proximity of the lower end of the ram member 15 and in parallel therewith in such a manner as to extend between the lower portions of the dependent plates 31*a* and 31*b*. A torsion bar 41 is rotatably held at its ends by means of shafts 43*a* and 43*b* by a pair of rocking members 45*a* and 45*b* which are pivotally mounted on the lower portions of the dependent plates 31*a* and 31*b*, respectively, by means of pins 47*a* and 47*b*, respectively. More particularly, the torsion bar 41 is formed at its ends with axial bores, and it is rotatably held be the rocking members 45*a* and 45*b* with the axial bores rotatably engaged by the shafts 43*a* and 43*b*, although the torsion bar 41 may be of course, so arranged as to be rotatably held by the rocking members 45*a* and 45*b* without the shafts 43*a* and 43*b*. Also, the rocking members 45*a* and 45*b* are prevented by adjusting bolt members 49, best seen in FIG. 3 from rotating downwardly about the pins 47*a* and 47*b*, respectively. Also, the rocking members 45*a* and 45*b* are biased by springs 51 against the adjusting bolt members 49 in order to hold the opposite ends of the torsion bar 41 in position.

On the other hand, the torsion bar 41 is connected to the lower opposite ends of the ram member 15 by means of a pair of link members 53*a* and 53*b*, another pair of link members 55*a* and 55*b*, and a pair of clevis members 57*a* and 57*b* so that it may be rotated as the ram member 15 is raised and lowered by the hydraulic motors 19*a* and 19*b*. The link members 53*a* and 53*b* are symmetrically fixed to the opposite ends of the torsion bar 41 in order to be connected with the link members 55*a* and 55*b*, respectively. Also, the clevis members 57*a* and 57*b* are symmetrically fixed to the opposite ends of the lower end of the ram member 15 in order to be connected with the link members 55*a* and 55*b*, respectively.

In the above described arrangement, the torsion bar 41 will be rotated by the ram member 15 through the links 53*a* and 53*b* between the rocking members 45*a* and 45*b* with its axis kept horizontal when the ram member 15 is being evenly raised by the hydraulic motors 19*a* and 19*b* with its opposite ends kept at a level with each other. Therefore, when the opposite ends of the ram member 15 are being raised equally by the hydraulic motors 19*a* and 19*b*, the torsion bar 41 will be rotated without becoming oblique and therefore without raising up either of the rocking members 45*a* and 45*b* against the springs 51. However, once the ram member 15 becomes oblique when being raised by the hydraulic motors 19*a* and 19*b*, the opposite ends of the torsion bar 41 cannot be equally rotated. Accordingly the torsion bar 41 will be subjected to torsion and will become oblique and will react against such torsion with a result that the end of the torsion bar 41, which is urged to rotate more quickly, will be raised without rotating. Also, when the ends of the torsion bar 41 are raised without rotating, the rocking members 45*a* and 45*b* will be rocked up against the spring 51 about the pins 47*a* and 47*b*. Thus, if the ram member 15 is raised much more, for example, by the hydraulic motor 19*a* than by the hydraulic motor 19*b*, the end of the torsion bar 41 having the link 53*a* will be raised without rotating to cause the rocking member 45*a* to rotate against the spring 51 around the pin 47*a*.

In order to control the hydraulic motors 19*a* and 19*b*, a pair of valve means 59*a* and 59*b* having spool members 61*a* and 61*b*, respectively, are mounted on the pendent plates 31*a* and 31*b*, respectively, just above the rocking members 45*a* and 45*b*. The valve means 59*a* and 59*b* are so constructed as to restrain and stop the hydraulic fluid from being delivered into the hydraulic motors 19*a* and 19*b*, respectively, according to the pressure by which the spool members 61*a* and 61*b* are pushed to control the movement of the ram member 15. Also, the spool members 61*a* and 61*b* of the valve means 59*a* and 59*b* are so arranged as to be pushed and released by the rocking member 45*a* and 45*b*, respectively, by means of push rod members 63*a* and 63*b*, respectively which are vertically slidably mounted on the dependent plates 31*a* and 31*b*. More particularly, the push rod members 63*a* and 63*b* are vertically slidably held by holding members 65*a* and 65*b* and other holding members 67*a* and 67*b* so that they may be brought by the rocking members 45*a* and 45*b* into contact with the spool members 61*a* and 61*b* when the rocking members 45*a* and 45*b* are swung up around the pins 47*a* and 47*b* by the torsion bar 41. Thus, the valve means 59*a* and 59*b* will control the hydraulic motors 19*a* and 19*b* to restrain or stop the ram member 15 from rising when the rocking members 45*a* and 45*b* are swung up around the pins 47*a* and 47*b* by the torsion bar 41.

In the above described arrangement when the ram member 15 becomes oblique when being raised, the torsion bar 41 will be made oblique by the ram member 15 to cause the rocking members 45*a* and 45*b* to push the spool members 61*a* and 61*b* of the valve means 59*a* and 59*b* by means of the push rod members 63*a* and 63*b* to restrain or stop the hydraulic fluid from being delivered into the hydraulic motors 19*a* and 19*b* so as to overcome the obliquity of the ram member 15. Thus, once the ram member 15 becomes oblique, the torsion bar 41 will cause the valve means 59*a* and 59*b* to restrain or stop the hydraulic motor 59*a* and 59*b* from urging the ram member 15 much more than the other. Therefore, the opposite ends of the ram member 15 and the lower tool 17 may be always kept at a level with each other. Also, on the other hand when the beam member 11 and the upper tool 13 becomes oblique because of deflections of the upright plates 3 and 5, the dependent plates 31*a* and 31*b* will be raised by the upright plates 3 and 5 which raise the torsion bar 41 and the valve means 59*a* and 59*b* together with all other members held by the dependent plates 31*a* and 31*b*. Thus, even if the beam member 11 and the upper tool 13 become oblique because of the deflections of the upright plates 3 and 5, the valve means 59*a* and 59*b* can control the hydraulic motors 19*a* and 19*b* in the same manner as when they are not oblique so that the upper tool 13 and the lower tool 17 may be always kept in parallel with each other so as to hold the lower tool 17 in parallel with the upper tool 13.

In order to adjust the moving limit of the lower tool 17 to the upper tool 13, a pair of bell crank members 69*a* and 69*b* having rollers 71*a* and 71*b*, respectively best seen in FIG. 1, are pivotally disposed on the connecting plate 9 by means of pins 73*a* and 73*b*, respectively. The bell crank members 69*a* and 69*b* are so arranged as to push the spool members 61*a* and 61*b* of the valve means 59*a* and 59*b* when rotated or swung about the pins 73*a* and 73*b*. Also, in order to enable the bell crank members 69*a* and 69*b* to push the spool members 61*a* and 61*b* of the valve means 59*a* and 59*b*, a pair of rocking members 75*a* and 75*b*, which are formed with cam portions 77*a* and 77*b*, are pivotally disposed on pins 79*a* and 79*b*, respectively, which are fixed to the ram member 15. The pins 79*a* and 79*b* for the rocking members 75*a* and 75*b* are fixed to the ram member 15 through elongate holes 81*a* and 81*b* formed vertically through the connecting plate 9 so that the rocking members 75*a* and 75*b* may be raised and lowered together with the ram member 15. Furthermore, a pair of elongate rocking member 83*a* and 83*b* having cam follower members 85*a* and 85*b* are pivotably mounted on the connecting plate 9 by means of pins 87*a* and 87*b* so that the cam portions 77*a* and 77*b* of the rocking members 75*a* and 75*b* may be brought into contact with the cam followers 85*a* and 85*b* when the rocking members 75*a* and 75*b* are raised together with the ram member 15. In this arrangement, as the rocking members 75*a* and 75*b* are raised by the ram member 15 with the cam portions 77*a* and 77*b* slid on the cam follower members 85*a* and 85*b*, they are rotated about the pins 79*a* and 79*b* to cause the bell crank member 69*a* and 69*b* to push the spool members 61*a* and 61*b* of the valve means 59*a* and 59*b*. The elongate rocking members 83*a* and 83*b* are pivotally connected by means of pins 89*a* and 89*b*, link members 91*a* and 91*b* and pins 93*a* and 93*b* to adjusting nut members 95*a* and 95*b* engaging with adjusting screws 97*a* and 97*b* which are rotatably held by holding members 99*a* and 99*b* mounted on the connecting plate 9. The adjusting screws 97*a* and 97*b* are connected with each other by a connecting bar member 101 and also the adjusting screw 97*a* is connected to a hand wheel 103 by a shaft 105. Also, the adjusting nut members 95*a* and 95*b* and the adjusting screws 97*a* and 97*b* are reversely threaded so that the adjusting nut members 95*a* and 95*b* may be simultaneously moved toward and away from each other when the hand wheel 103 is rotated. Thus, when the handwheel 103 is rotated in either direction to rotate the adjusting screws 97*a* and 97*b* in the holding members 99*a* and 99*b*, respectively, the adjusting nut members 95*a* and 95*b* will be simultaneously moved by the adjusting screws 97*a* and 97*b*, respectively, in either direction toward and away from each other. Accordingly, the elongate rocking members 83*a* and 83*b* will be simultaneously rotated or rocked in either direction by the adjusting nut members 95*a* and 95*b*, respectively, around the pins 87*a* and 87*b*, respectively, when the handwheel 103 is rotated in either direction.

In the above-described arrangement, the cam followers 85*a* and 85*b* will be simultaneously moved by the elongate rocking members 83*a* and 83*b* in the opposite directions toward and away from the bell crank members 69*a* and 69*b*, respectively, when the handwheel 103 is rotated. Thus, the cam followers 85*a* and 85*b* of the elongate rocking members 83*a* and 83*b* can be adjustably positioned by rotating the handwheel 103 so that the cam portions 77*a* and 77*b* of the rocking members 75*a* and 75*b* may be brought into contact therewith in desired positions when the rocking members 75*a* and 75*b* are raised together with the ram members 15. As is readily understood, when the cam followers 85*a* and 85*b* are positioned nearer to the bell crank members 69*a* and 69*b*, respectively, the cam portions 77*a* and 77*b* will be brought into contact with the cam followers 85*a* and 85*b*, respectively, earlier at the lower positions by the rocking members 75*a* and 75*b*, respectively, and vice versa. Accordingly, when the cam followers 85*a* and 85*b* are positioned near to the bell crank members 69*a* and 69*b*, the bell crank members 69*a* and 69*b* will be rotated around the pins 73*a* and 73*b*, respectively, earlier by the rocking members 75*a* and 75*b*, respectively, to push the spool members 61*a* and 61*b* of the valve means 59*a* and 59*b*, respectively, and vice versa. Also, when the spool members 61*a* and 61*b* are fully pushed by the bell crank members 69*a* and 69*b*, of course, the valve means 59*a* and 59*b* will cause the hydraulic motors 19*a* and 19*b* to stop the ram member 15 from rising together with the lower tool 17, as has been described hereinbefore. Thus, it will be now understood that the upper moving limit of the lower tool 17 to the upper tool 13 can be accurately and easily adjusted according to the dimensions and the tensile strength of the workpiece W to be bent by rotating the handwheel 103 in either direction.

Figure 4:
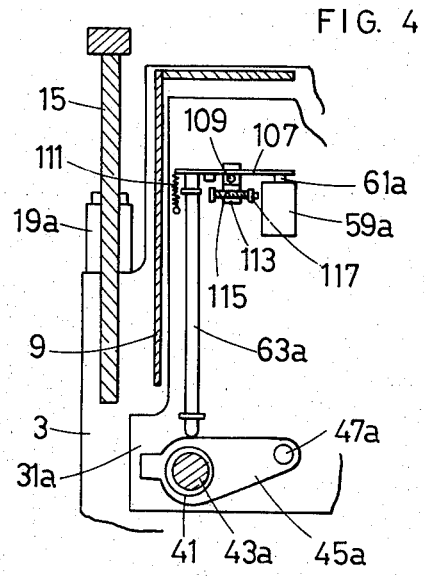
FIG. 4 is a partial view showing a modified embodiment of a portion of the hydraulic press shown in FIG. 1.

Referring to FIG. 4, there is shown a modified embodiment in which the spool member 61*a* of the valve means 59*a* is so arranged as to be pushed by the push rod member 63*a* by means of a lever member 107 which is supported by a pin 109 acting as a fulcrum. The lever member 107 is supported by the pin 109 near one of its ends and is biased by a spring 111 at the top end of the push rod member 63*a*. The other end of the lever 107 is kept in contact with the spool member 61*a* of the valve means 59*a*. The pin 109 is held by an adjusting nut member 113 which is adjustably held by a screw member 115 mounted on the dependent plate 31*a* by a supporting member 117. In this arrangement, when the push rod member 63*a* is raised by the rocking members 45*a*, the lever member 107 will be swung against the spring 111 about the pin 109 like a seesaw to push the spool member 61*a* of the valve means 59*a*. Also, the pin 109 can be adjustably moved along with the lever member 107 by rotating the screw member 113 so as to adjust the action of the push rod member 63*a* to the spool member 61*a* for the purpose of finely adjusting the response to the obliquity of the upper and lower tools 13 and 17, respectively.

As has been so far described above, the upper and lower tools 13 and 17 are kept always in parallel with each other by means of the torsion bar 41, the rocking members 45*a* and 45*b* constituting link motions, and the valve means 59*a* and 59*b* which are all held by the dependent plates 31*a* and 31*b*in the hydraulic press 1. Also, the upper moving limit of the lower tool 17 to the upper tool 13 can be accurately and easily adjusted only by rotating the handwheel 103 in either direction according to the dimensions and the tensile strength of the workpiece W to be bent in the hydraulic press 1. Thus, the hydraulic press 1 according to the present invention can be easily operated to accurately bend the workpiece W.

Although a preferred forms of the present invention have been illustrated and described, it should be understood that the device is capable of modification by one skilled in the art without departing from the principles of the invention. Accordingly, the scope of the invention is to be limited only by the claims appended hereto.

I claim:

1. A hydraulic press, comprising:

a fixed tool;

a movable tool;

a ram means for holding the movable tool and being so disposed as to be vertically moved toward and away from the fixed tool;

a pair of upright plate means for holding the fixed tool;

a beam member fixedly supported between the pair of upright plate means;

a pair of dependent plate members pivotally provided at inner sides of the upright plate means;

hydraulic motor means for driving the ram means;

a pair of valve means, each mounted on one of the pair of dependent plate members;

rocking arm members pivotally supported by the dependent plate members; and a torsion bar member rotatably held at its ends by the rocking arm members;

whereby linking means is provided to connect end portions of the torsion bar member with end portions of the ram means so that the rocking arm members may actuate the valve means.

2. A hydraulic press, comprising:

a fixed tool;

a movable tool;

a ram means for holding the movable tool and being so disposed as to be vertically moved toward and away from the fixed tool;

a pair of upright plate means for holding the fixed tool;

a beam member fixedly supported between the pair of upright plate means;

a pair of hydraulic motor means, each mounted on one of the upright plate means, for driving the ram means;

a pair of valve means, each mounted on one of the upright plate means;

a pair of valve controlling means for controlling the pair of valve means;

a pair of rocking means, mounted on the ram means, for actuating the pair of valve controlling means; and means for adjusting the actions of the pair of rocking means.

* * * * *